US005947640A

United States Patent [19]

Connors

[11] Patent Number: 5,947,640

[45] Date of Patent: Sep. 7, 1999

[54] PORTABLE WATER CONVEYANCE ASSEMBLY

[76] Inventor: James P Connors, 31 Kimberly Dr., Dryden, N.Y. 13053

[21] Appl. No.: 08/903,987

[22] Filed: Jul. 31, 1997

[51] Int. Cl.[6] ..... E02B 3/00; F16L 11/00

[52] U.S. Cl. ..... 405/83; 137/372; 138/109; 138/118; 405/36; 405/127

[58] Field of Search ..... 405/52, 80, 81, 405/83, 102, 127, 107, 115, 36; 137/363, 372; 138/109, 118, 118.1

[56] References Cited

U.S. PATENT DOCUMENTS

| | | | |
|---|---|---|---|
| 530,655 | 12/1894 | Richardson | 405/81 |
| 2,652,798 | 1/1953 | Reed | 112/236 |
| 3,772,891 | 11/1973 | Raistakka | 405/83 |
| 4,437,431 | 3/1984 | Koch | 405/83 |
| 4,629,361 | 12/1986 | Zimmerman | 405/83 |
| 5,242,244 | 9/1993 | Dockery | 405/52 |

FOREIGN PATENT DOCUMENTS 1781378 12/1991 U.S.S.R. .

*Primary Examiner*—Tamara L. Graysay
*Assistant Examiner*—Tara L. Mayo
*Attorney, Agent, or Firm*—Roylance, Abrams, Berdo & Goodman, L.L.P.

[57] ABSTRACT

A portable water conveyance device for diverting the flow of water and particularly, a stream, includes a collapsible tube for receiving the water and conveying the water downstream to a discharge site. An inlet frame is coupled to the inlet end of the tube to hold the end of the tube open and direct the water into the tube. A pair of pivotally mounted wing walls are attached to the sides of the walls to direct the water into the tube. In embodiments, an outlet frame is coupled to the discharge end of the tube. The outlet frame is mounted on a support structure to adjust the height of the outlet frame with respect to the ground and water level at the discharge end of the tube. A ledge is attached to the lower end of the outlet frame and extends outwardly therefrom in the downstream direction. The shelf extends a distance to inhibit the upstream migration of marine animals that may climb up the support structure. The height of the outlet frame also can be adjusted to control the migration of marine life.

19 Claims, 6 Drawing Sheets

PORTABLE WATER CONVEYANCE ASSEMBLY

FIELD OF THE INVENTION

The present invention is directed to a portable water conveyance assembly for temporarily diverting water, such as a stream from its normal course and conveying the water to a desired location. The invention is further directed to a water conveyance assembly having a discharge frame for controlling the upstream migration of selected marine animals.

BACKGROUND OF THE INVENTION

It is often necessary to divert a stream from its natural stream bed during various construction projects, such as, road or bridge construction. The diversion of streams usually requires excavating a temporary stream bed around the construction zone and sufficiently far downstream to avoid interfering with the construction project. At the completion of the construction project, the temporary stream bed must be filled to return the land to its original condition.

Other methods for temporarily diverting a stream require the construction of walls and barriers. The walls can be made of concrete blocks, stone and the like. Although effective in diverting the flow of water, the high construction cost of the temporary walls limits their use.

Another disadvantage of these prior temporary stream diversion systems is that these construction techniques can produce large amounts of silt and mud in the water which can be harmful to fish and plant life downstream of the construction area. Moreover, changing the natural stream bed can affect the migration of marine animals upstream and downstream of the temporary stream bed. For example, the temporary stream bed may avoid a natural barrier, such as rapids or a waterfall which provide natural barriers to certain types of marine animals that are not able to traverse the natural barrier.

Numerous systems have been developed to provide a bypass for fish to swim freely around an obstruction, such as, a dam. Examples of devices around objects such as a dam, while allowing the migration of fish are disclosed in U.S. Pat. No. 4,437,431 to Koch, U.S. Pat. No. 3,772,891 to Raistakka and U.S. Pat. No. 4,629,361 to Zimmerman. Examples of fish ladders having a series of steps are disclosed in U.S. Pat. No. 2,625,798 to Reed and U.S. Pat. No. 530,655 to Richardson.

Flexible tubes have also been used to convey water from one location to another. For example, U.S. Pat. No. 5,242,244 to Dockery discloses a sleeve for placing in the flow path of a body of water. The current of moving water is funneled into the sleeve to still or pacify the water surrounding the sleeve. The area of still water around the sleeve is then treated with various chemical agents to treat underwater vegetation without introducing the chemical agents into the water current.

The above-noted systems, although generally effective for their intended purposes, are not entirely satisfactory for temporarily diverting surface water. Accordingly, a continuing need exists in the industry for a portable water conveyance system.

SUMMARY OF THE INVENTION

The present invention is directed to a portable water conveyance system for temporarily diverting a stream. Accordingly, a primary object of this invention is to provide a water conveyance system that is effective in conveying water from its natural stream bed to a downstream location.

Another object of the invention is to provide a portable water conveyance system that is easy to construct and utilize.

A further object of the invention is to provide a modular water conveyance system made of flexible tubular material that is collapsible and easily transported.

Another object of the invention is to provide a water conveyance system having an inlet frame and at least one wall attached to the inlet frame for funneling and directing water into the tube.

Still another object of the invention is to provide a water conveyance system having a water tube and an outlet frame assembly for adjusting the height of the outlet end of the water tube from the ground to selectively control migration of marine animals through the water tube.

A further object of the invention is to provide a water conveyance system having a water discharge assembly having a substantially horizontal ledge extending outwardly from a support structure and positioned above the stream bed for selectively controlling upstream migration of marine animals.

The objects of the invention are basically attained by providing a water conveyance assembly for temporarily diverting water from a stream bed comprising: a flexible and collapsible water conveyance tube having an inlet end and a discharge end; a rigid inlet frame having an outer dimension complementing the inlet end of the tube, a coupling means for coupling the inlet end of the tube being coupled to the inlet frame for holding the inlet end open for receiving water; at least one anchor coupled to the inlet frame for anchoring the inlet frame to a stream bed; at least one wall member pivotally coupled to a side of the inlet frame, wherein the angle of the wall member with respect to the inlet frame is adjustable to direct water from a stream bed into the tube.

The objects of the invention are further attained by providing a water conveyance and marine life migration control assembly, comprising: a flexible and collapsible water conveyance tube having a water inlet end and water discharge end; a rigid inlet frame having an outer dimension complementing the inlet end of the tube, the frame being coupled to the inlet end of the tube for supporting the inlet end open for receiving water; at least one anchor coupled to the frame for anchoring the frame to the ground; and an outlet frame assembly having an outlet frame coupled to the discharge end of the tube for discharging water, the outlet frame assembly having a ground-engaging base, and a substantially upright support structure having a lower end coupled to the base and an upper end coupled to the outlet frame, the support structure supporting the outlet frame and outlet end of the tube above the ground thereby selectively controlling upstream migration of marine life through the tube.

The objects of the invention are also attained by providing a method of diverting the direction of water comprising the steps of: providing a water conveyance assembly having a flexible and collapsible tube and a rigid inlet frame assembly, and at least one side wall pivotally coupled to a side rail of the inlet frame assembly; securing the inlet frame to the ground in the path of the water and positioning the inlet frame for receiving the water; coupling an inlet end of the tube to the inlet frame, wherein the inlet frame directs the flow of water into the tube; pivotally adjusting the relative position of the side wall with respect to the inlet frame and positioning the side wall in the water and diverting the flow of water into the inlet frame and tube; and positioning the outlet end of the tube at a selected location and discharging the water from the tube.

The objects of the invention are also attained by providing a method of diverting the downstream flow of water and controlling upstream migration of marine animals, comprising the steps of: providing a water conveyance assembly having a water conveyance tube, an inlet frame assembly coupled to a water inlet end of the tube and an outlet frame assembly coupled to a discharge end of the tube; securing the inlet frame assembly in a stream bed and diverting water into the inlet end of the tube; positioning the discharge end of the tube downstream of the inlet end; the outlet frame assembly comprising a ground engaging base, a substantially upright support structure and an outlet frame coupled to the support structure and spaced above the base, the outlet frame further being coupled to the discharge end of the tube for supporting the discharge end, the method further comprising positioning the discharge end of the tube above a water level at the discharge end of the tube a height to selectively control upstream migration of marine animals.

The objects, advantages and salient features of the invention will become apparent from the following detailed description, which, taken in conjunction with the annexed drawings, disclose various embodiments of the invention.

BRIEF DESCRIPTION OF THE DRAWINGS

Referring to the drawings which form a part of this disclosure in which.

DETAILED DESCRIPTION OF THE INVENTION

The present invention is directed to a portable water conveyance assembly 10 comprising a flexible water conveyance tube 12, an inlet frame assembly 14, and an outlet frame assembly 16. The water conveyance assembly 10 is constructed for temporarily diverting water from a creek or stream and carrying the water to a location downstream.

Figure 1:
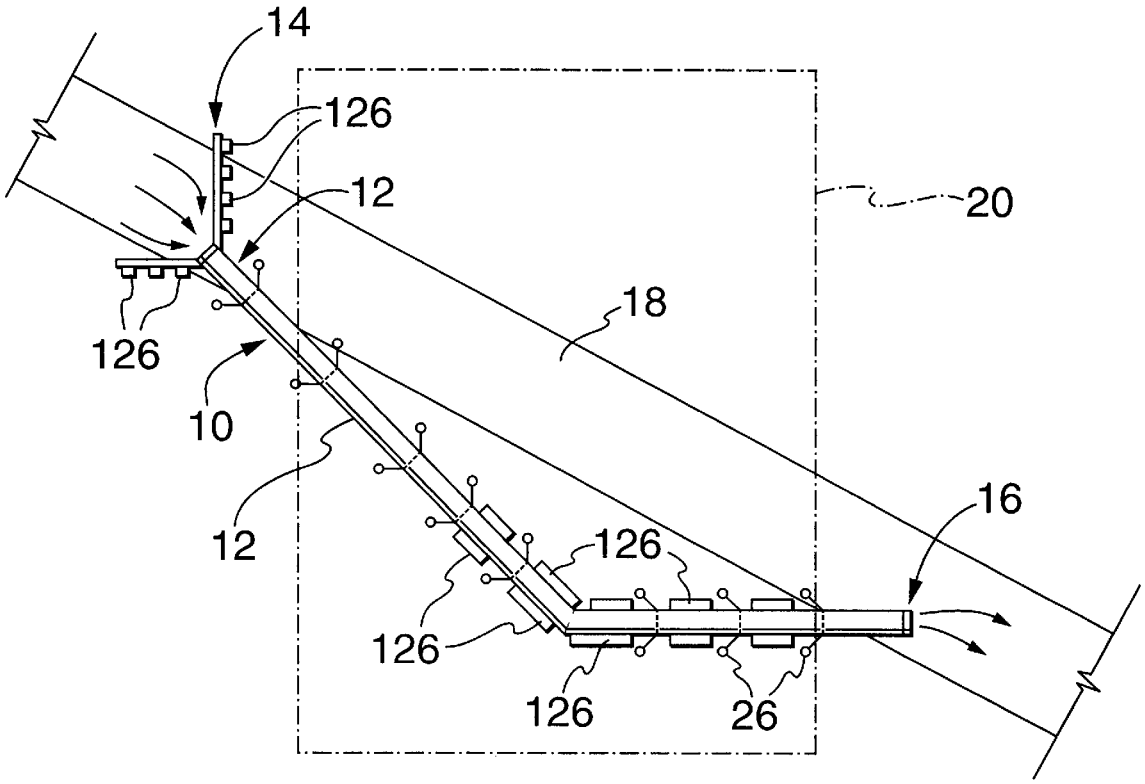
FIG. 1 is a schematic diagram showing the water conveyance system in a preferred embodiment of the invention.

Referring to FIG. 1, the portable water conveyance assembly 10 is particularly suitable for collecting water from a stream 18 upstream of a designated area 20 and discharging the water downstream of the designated area 20. The area 20 can be, for example, a construction area for constructing a bridge or road where it is necessary to divert the natural flow of water temporarily during the construction project. At the end of the construction project, the water conveyance assembly 10 is disassembled and removed, thereby allowing the water to resume its natural course through the stream bed 18.

The water conveyance tube 12 of assembly 10 is a flexible and collapsible tube made from a suitable polymeric material. One example of a suitable material is 28 ounce reinforced polyvinylchloride membrane. Other suitable materials can be 35 mil black aquaculture grade flexible PVC material. The diameter of the water conveyance tube 12 can vary depending on the intended use and the volume of water the tube is expected to carry. Generally, the diameter of the water conveyance tube 12 is between about 2 and about 6 feet.

The length of the water conveyance tube 12 can vary depending on the use of the tube and the requirements for the particular use. Preferably, the water conveyance tube 12 is manufactured in selected lengths. A number of tubes 12 can be coupled together as needed to obtain the desired length.

Figure 6:
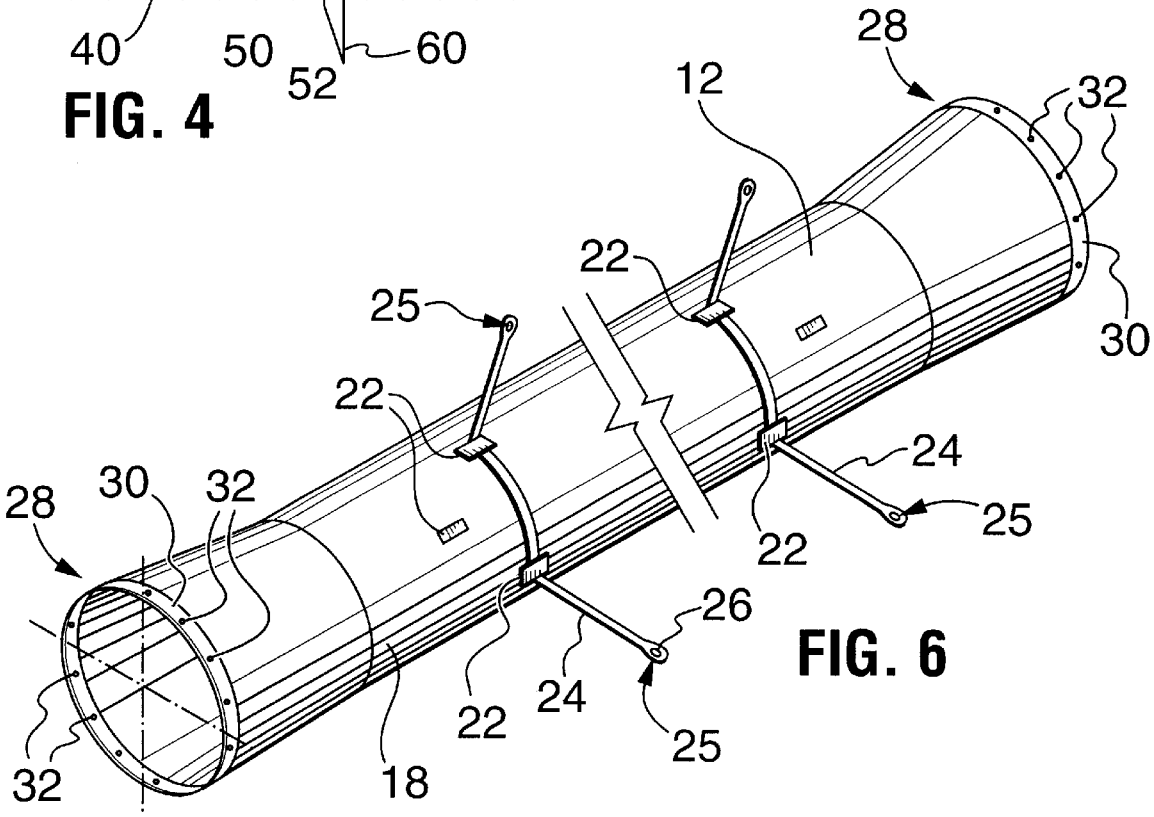
FIG. 6 is a perspective view of the water conveyance tube in a preferred embodiment.

As shown in FIG. 6, the water conveyance tube 12 has an elongated tubular shape and includes a plurality of loops 22 for receiving straps 24. Straps 24 include an eyelet 25 or other fastening device for anchoring the straps and the water conveyance tube in place. As shown in FIG. 6, the straps 24 extend through the loops 22 and are anchored to the ground by stakes 26 or other anchoring devices.

In the embodiment illustrated in FIG. 6, the ends of the water conveyance tube 12 are tapered slightly outwardly so that the ends of the tube are slightly larger than the middle section of the tube. The ends 28 of the tube are folded over to form a double thickness 30 to increase the strength of the ends of the tube 12. A plurality of eyelets or grommets 32 are provided in the double layer 30 for coupling the tubes 12 to one another and to the inlet frame assembly 14 and to the outlet frame assembly 16. The ends of adjacent tubes can be attached together by inserting the discharge end of one tube into the inlet end of the adjacent tube and passing bolts or other fastening devices through the grommets 32.

The tube 12 is sufficiently flexible to be rolled or folded when not in use for ease of storage and transport. The flexibility of the tube 12 allows the tube to be laid out over rough terrain, bend around obstacles and traverse inclines regardless of slope without excavation of the area.

Figure 2:
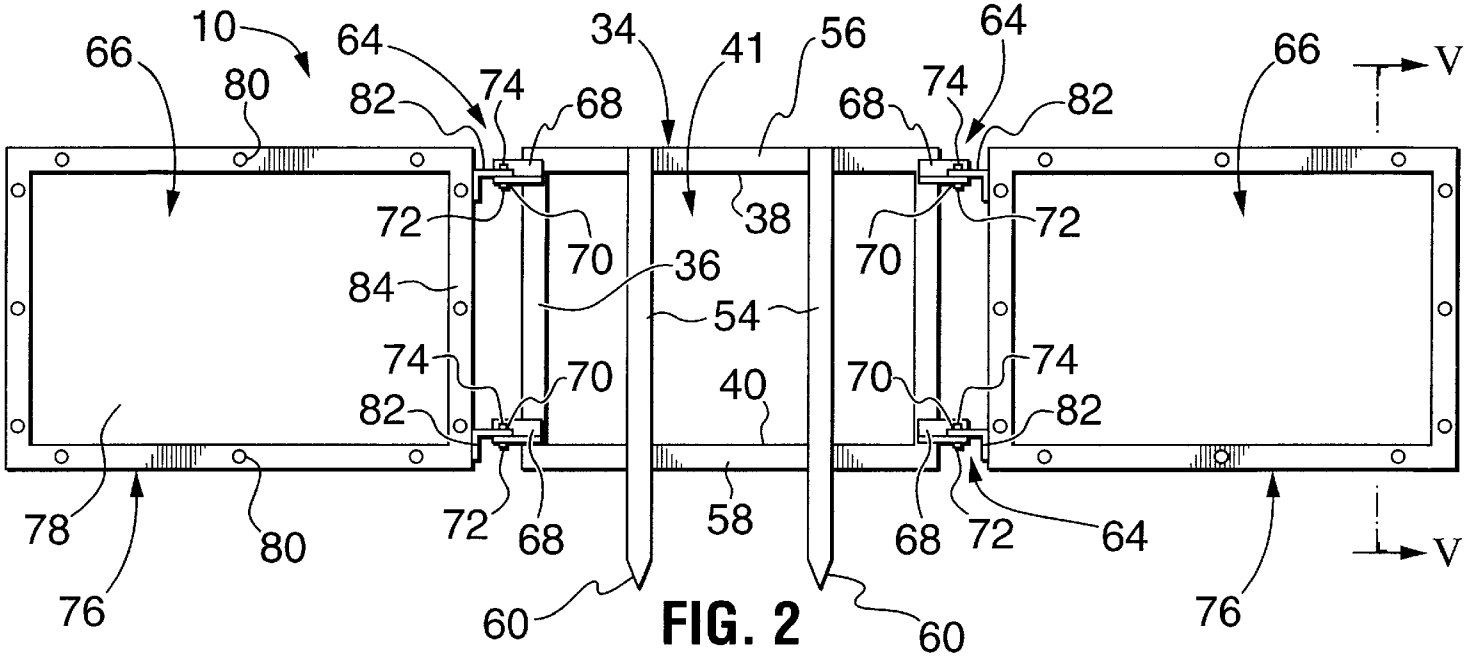
FIG. 2 is a front end view of the water inlet frame and movable walls in a preferred embodiment of the invention.

Referring to FIGS. 2–5, the inlet frame assembly 14 includes an outer frame 34 for attaching to the flexible tube 12. As shown in FIG. 2, the frame 34 has a substantially rectangular shape, although in alternative embodiments, the shape of the frame 34 can be varied as desired. Frame 34 is preferably constructed from a durable corrosion-resistant material having sufficient strength to support the tube 12 and to withstand the force of the moving water. In preferred embodiments, frame 34 is constructed from aluminum tubing. Other suitable materials include steel or rigid plastic materials.

Figure 3:
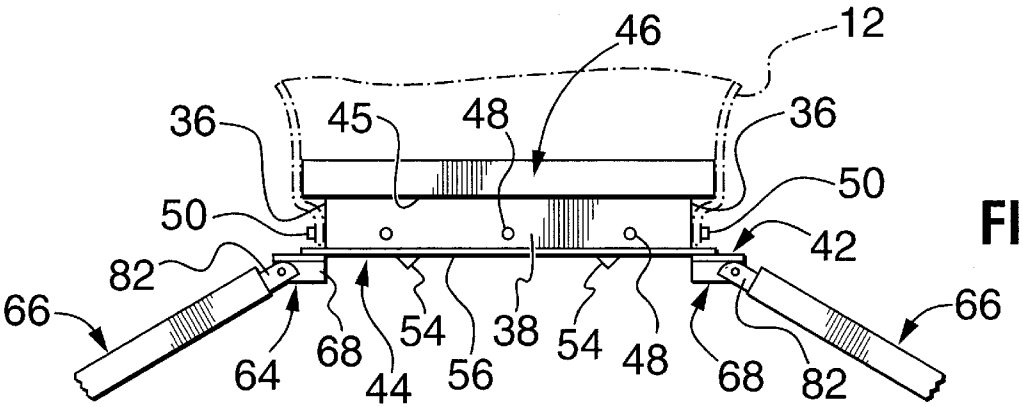
FIG. 3 is a partial top view of the inlet frame of FIG. 2.
Figure 4:
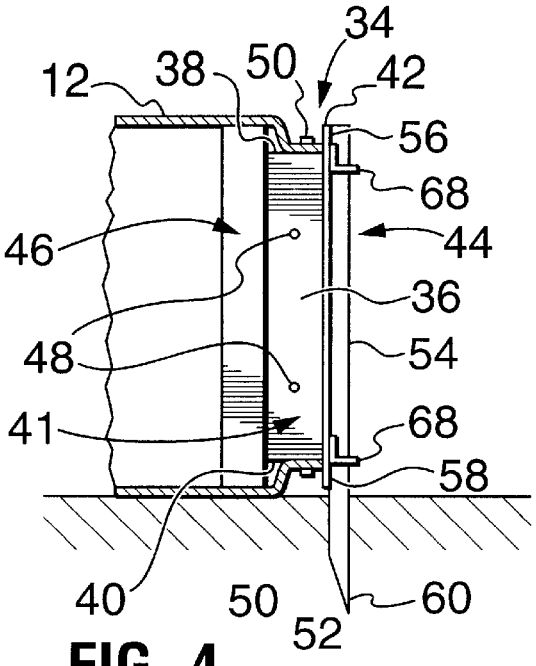
FIG. 4 is a side elevational view of the inlet frame without the attached wings.

In the embodiment illustrated, outer frame 34 includes two opposite side walls 36, a top wall 38 and a bottom wall 40 which define a water inlet opening 41. The dimensions of the frame 34 and inlet opening 41 are dependent on the volume of water the assembly is expected to carry. A front flange 42 is attached to the frame 34 at the inlet side 44 and extends outwardly from the side walls 36, top wall 38, and bottom wall 40. As shown in FIGS. 3 and 4, flange 42 defines the front face of the inlet frame assembly surrounding the inlet opening 41. A collar 46 is attached to the downstream side 45 of the frame 34 and is spaced outwardly from the side walls 36, top wall 38 and bottom wall 40. As shown in FIG. 4, the front flange 42 and collar 46 extend outwardly from the side walls 36, top wall 38 and bottom wall 40 about the same distance.

The side walls 36, top wall 38 and bottom wall 40 each include a plurality of apertures 48 extending through the frame. The apertures 48 are dimensioned to receive a bolt 50. As shown in FIG. 4, the bolts 50 pass through the apertures 48 in the frame and through the grommets 32 of the flexible tube 12 where a nut 52 is threaded to the bolt to attach the tube 12 to the frame 34. The apertures 48 are spaced apart a suitable distance sufficient to attach the tube 12 securely to the frame 34 and to withstand the forces of the moving water entering the tube 12.

In the embodiment illustrated, two anchoring stakes 54 are attached to the upper rail 56 and lower rail 58 of the flange 42 and extend below the lower rail 58 a sufficient distance to anchor the frame 34 in the ground. The anchoring stakes 54 are preferably welded to the upper rail 56 and lower rail 58 and terminate at a sharp point 60. As shown, the anchoring stakes 54 are positioned on the flange 42 to form a grate to prevent branches and other debris from entering the tube 12 without interfering with the flow of water and migration of marine wildlife. The number of stakes attached to the flange 42 is dependent on the width of the frame 34.

The side rails 62 of flange 42 include upper and lower hinges 64 for coupling movable wall sections 66 with respect to the frame 34. As shown in FIGS. 2 and 3, hinges 64 include a hinge plate 68 attached to the side rails 62 of flange 42. Hinge plates 68 include an aperture 70 for receiving a nut 72 and bolt 74 for pivotally coupling the walls 66 to the frame 34.

Figure 5:
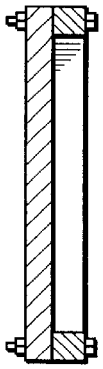
FIG. 5 is a cross-sectional end view of the movable wall taken along line 5—5 of FIG. 2.

Movable walls 66 include a frame 76 which defines the perimeter of the frame. The frame 76 can be constructed from hollow tubular material such as aluminum tubing having sufficient strength to support the wall 66. A panel 78 is attached to the frame 76 by bolts 80 extending through the panel 78 and the frame 76 as shown in FIG. 5. In further embodiments, the panel 78 can be attached to the frame 76 by U-shaped bolts extending around the frame 76 or by other suitable attachment devices. Hinge brackets 82 are attached to the side rail 84 of the frame 76 for coupling with the hinge plate 68 of the frame 34.

Referring to FIGS. 1 and 2, a movable wall 66 is attached to each side of the inlet frame 34 and can be pivoted to the desired angle with respect to the frame 34 for directing water into the inlet frame 34. The two movable walls 66 can be the same length and height as shown in FIG. 2, or can be different lengths as shown in FIG. 1. The movable walls 66 are independently adjustable with respect to the frame 34 to accommodate differences in the width and depth of the stream bed.

Figure 7:
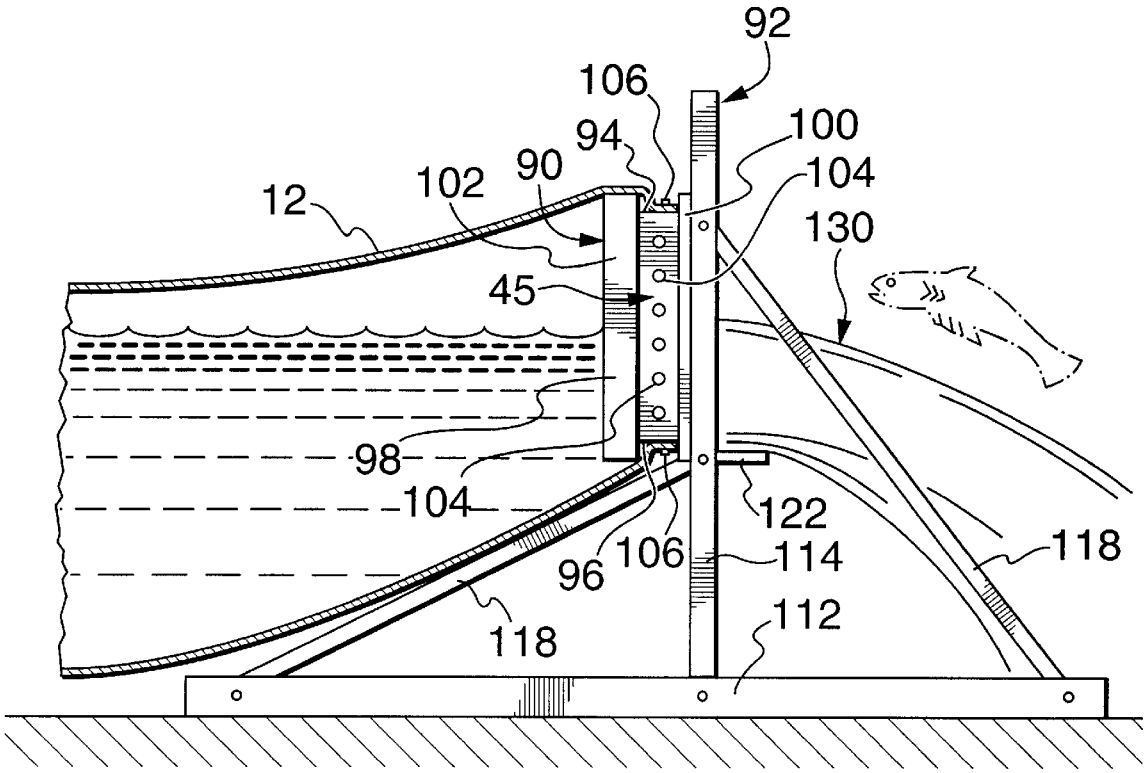
FIG. 7 is a side elevational view taken in partial cross-section showing the discharge outlet and frame of the water conveyance system.
Figure 8:
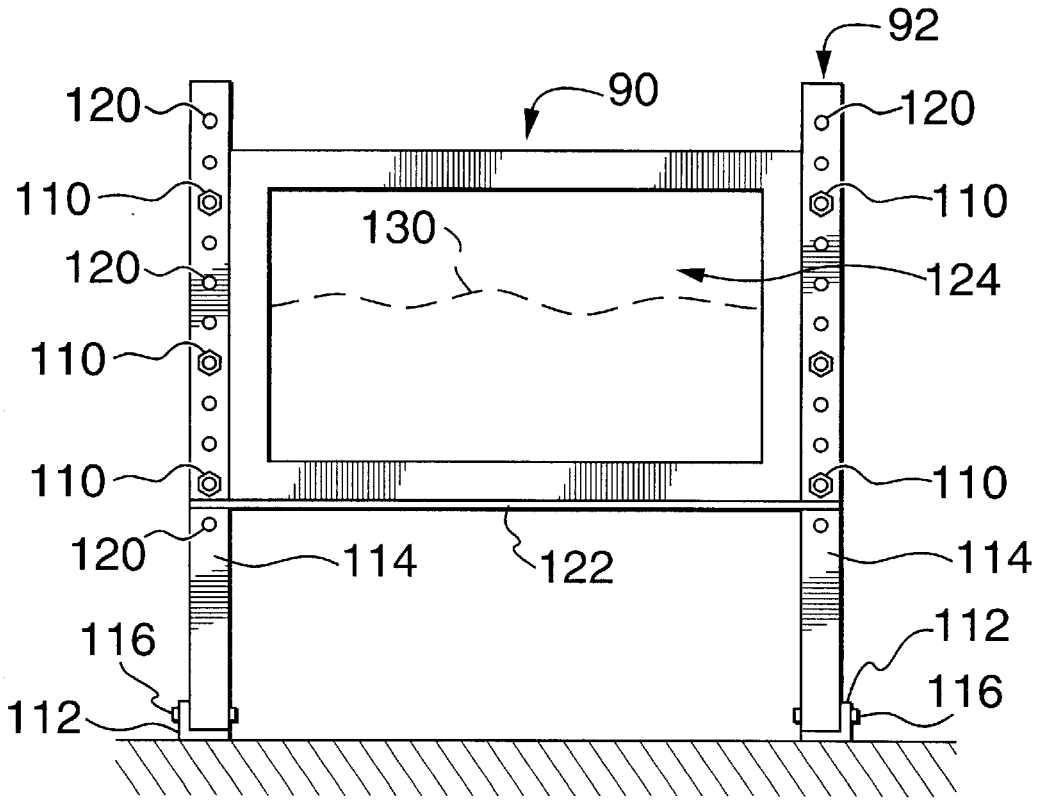
FIG. 8 is an end view of the outlet frame and support taken from the downstream end of the frame.
Figure 9:
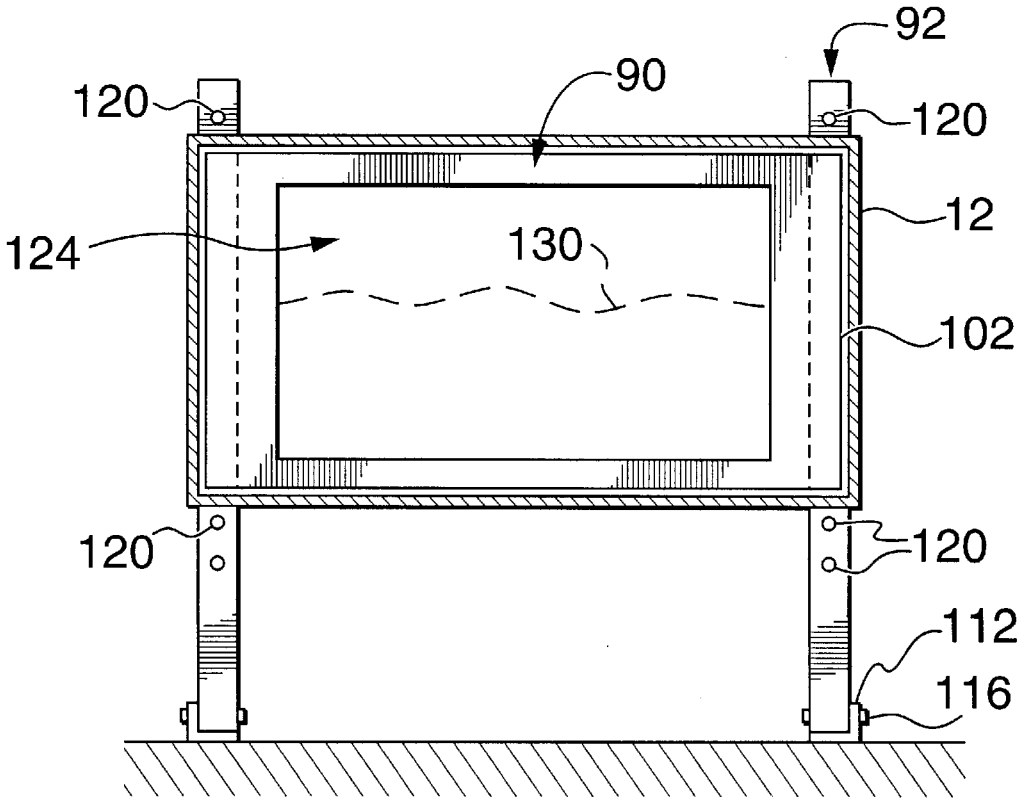
FIG. 9 is an end view of the outlet frame taken from the upstream end of the frame.
Figure 10:
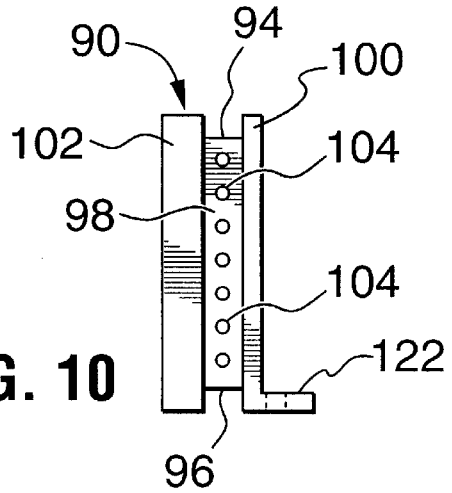
FIG. 10 is a side elevational view of the outlet frame.
Figure 11:
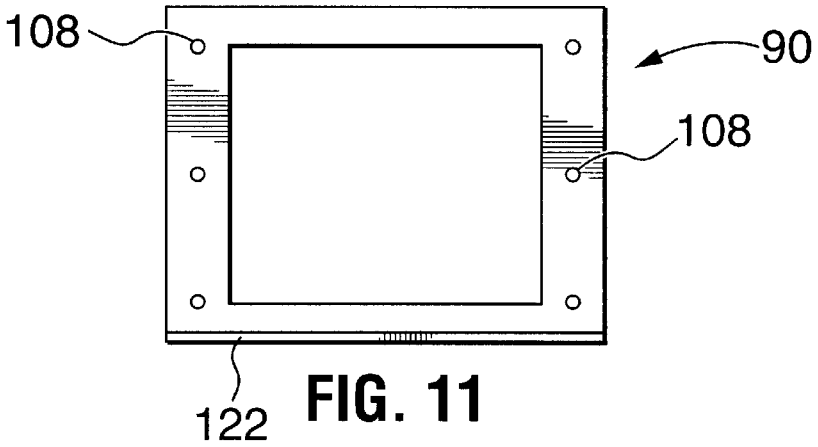
FIG. 11 is a front elevational view of the outlet frame taken from the right of FIG. 10.

Outlet frame assembly 16, as shown in FIGS. 7–11, includes an outlet frame 90 attached to a support 92 for elevating the outlet of the tube 12 above the stream bed. The outlet frame 90 is similar in construction to the inlet frame 34. Outlet frame 90 includes a top wall 94, a bottom wall 96 and opposite side walls 98. A front flange 100 is attached to the edges of the top wall 94, bottom wall 94 and side walls 98 and extends substantially perpendicular thereto. A collar 102 is attached to the frame opposite the flange 100 and extends perpendicular to the frame. A series of bolt holes 104 are provided in the top wall 94, bottom wall 96 and side walls 98 for attaching the discharge end of the tube 12 to the outlet frame 90. As shown in FIG. 7, the discharge end of tube 12 is attached to the frame 90 by bolts 106 extending through the holes 104 and through the grommets 32 in the tube 12. The flange 100 also includes bolt holes 108 for attaching the outlet frame 90 to the support structure 92 by bolts 110 as shown in FIGS. 8 and 11.

The support structure 92 includes a base 112 and a pair of upright supports 114. The upright supports 114 are coupled to the base 112 by bolts 116. Cross braces 118 as shown in FIG. 7 extend from the upright supports 114 to the base 112.

Referring to FIGS. 8 and 9, the upright supports 114 include a series of holes 120 for receiving the bolts 110 for attaching the outlet frame 90 to the supports 92. The holes 120 in the support 114 are spaced-apart so that the height of the outlet frame can be adjusted with respect to the ground. In this manner, the discharge outlet 124 of the outlet frame 90 and water conveyance tube 12 can be elevated above the ground to produce a waterfall as illustrated in FIG. 7. This waterfall 130 replaces a natural barrier which prevents selected marine animals from migrating upstream without interfering with the normal migration of certain animals.

Figure 12:
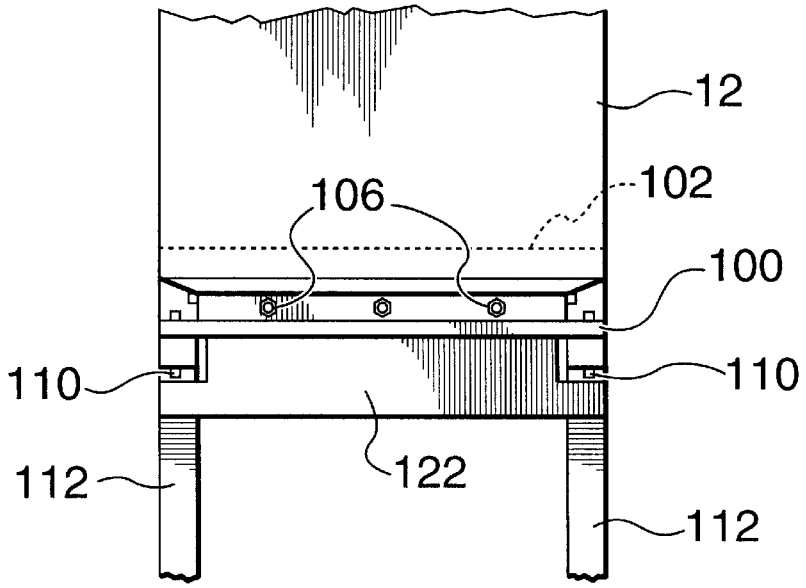
FIG. 12 is a top view of the outlet frame assembly of FIG. 7.

Referring to FIGS. 10–12, the outlet frame 90 includes a ledge 122 along the bottom rail and extending perpendicular from the flange 100. The ledge 122 extends outward from flange 100 a distance of about 8–12 inches in preferred embodiments of the invention. Ledge 122 has a width to extend adjacent the supports 114 and is closely spaced from the supports 114 to prevent marine animals from passing between the supports 114 and the ledge 122. The ledge 122 directs the water 130 discharging the outlet frame in a horizontal direction away from the support frame 114.

The ledge 122 further provides a barrier to prevent certain marine animals from climbing up the support structure 114 and through the opening 124 in the frame 90 and into the water conveyance tube 12. Certain marine animals, such as, for example, the lamprey eel, are able to physically climb a vertical structure so that the selective control of the upstream migration of these animals is particularly difficult. However, most marine animals are not capable of maneuvering around a horizontal barrier that extends outwardly from the vertical structure as shown in FIG. 7. Since these animals are not capable of climbing along the underside of the ledge 122, the ledge effectively inhibits the upstream migration through the water conveyance tube of these animals which must climb over the barriers. Elevating the outlet frame 90 thereby prevents migration of some marine animals, but does not restrict migration of fish that are able to jump over obstacles.

In use, the water conveyance tube 12 is attached to the inlet frame assembly 14 by bolting or otherwise fastening the inlet end of the tube 12 to the frame 36. In a similar manner, the discharge end of the water conveyance tube 12 is attached to the outlet frame assembly 16. The inlet frame assembly 14 is positioned in the stream bed 18 and the walls 66 are positioned to directed the water from the stream into the opening of the inlet frame as depicted in FIG. 1. The lower end 60 of the anchoring stakes 54 are embedded into the ground to secure the inlet frame 34 in position. A strap 128 can be extended over the inlet frame and securely fastened to suitable anchors on each side of the stream to further secure the frame. A ratchet can be used to tighten the strap. Concrete blocks 126, sand bags or other objects may be positioned on the downstream side of the walls 66 to stabilize the walls 66 and the inlet frame assembly 14. The water conveyance tube 12 is then laid out to carry the water from the stream bed to a selected downstream location. The straps 24 are anchored by stakes 26 to secure the position of the water conveyance tube during use. Concrete blocks or barriers 126 can also be placed adjacent the water conveyance tube 12 to stabilize the position of the tube. The outlet frame 90 is adjusted with respect to the support assembly 92 to the desired height.

While advantageous embodiments have been chosen to illustrate the invention, it will be understood by those skilled in the art that various changes can be made without departing from the scope of the invention as defined in the appended claims.

What is claimed is:

1. A water conveyance assembly for temporarily diverting water from a stream bed comprising:

a flexible and collapsible water conveyance tube having an inlet end and a discharge end;

a rigid inlet frame having an outer dimension complementing said inlet end of said tube, a coupling device for coupling said inlet end of said tube to said inlet frame for holding said inlet end open for receiving water;

at least one anchor coupled to said inlet frame for anchoring said inlet frame to a stream bed;

at least one wall member pivotally coupled to a side of said inlet frame, wherein the angle of said wall member with respect to said inlet frame is adjustable to direct water from a stream bed into said tube.

2. The assembly of claim 1, wherein said at least one anchor comprises a stake fixed to said inlet frame for embedding in the ground.

3. The assembly of claim 2, wherein said stake is fixed to an upper and lower edge of said inlet frame.

4. The assembly of claim 1, wherein said inlet frame comprises hinges on opposite side edges of said inlet frame, and a side wall member coupled to each of said hinges and pivotal with respect to said inlet frame.

5. The assembly of claim 1, wherein said at least one wall member has a height substantially equal to a height of said inlet frame.

6. The assembly of claim 1, wherein said at least one wall member is removably coupled to said inlet frame.

7. The assembly of claim 1, further comprising an outlet frame assembly coupled to said discharge end of said tube for discharging water, said outlet frame having a base, a support structure and an outlet frame coupled to said discharge end of said tube, wherein said outlet frame has a lower edge and a substantially horizontal ledge extending outwardly therefrom in a downstream direction.

8. The assembly of claim 7, wherein said outlet frame is adjustable with respect to said base along a length of said support structure to selectively position said outlet frame above said base.

9. The assembly of claim 1, wherein said tube further includes anchor straps for anchoring said tube in place.

10. The assembly of claim 1, wherein said tube comprises a plurality of tubes coupled together end to end.

11. A water conveyance and marine life migration control assembly, comprising:

a flexible and collapsible water conveyance tube having a water inlet end and water discharge end;

a rigid inlet frame having an outer dimension complementing said inlet end of said tube, said frame being coupled to said inlet end of said tube for supporting said inlet end open for receiving water;

at least one anchor coupled to said frame for anchoring said frame to the ground; and an outlet frame assembly having an outlet frame coupled to said discharge end of said tube for discharging water, said outlet frame assembly having a ground-engaging base, and a substantially upright support structure having a lower end coupled to said base and an upper end coupled to said outlet frame, said support structure supporting said outlet frame and outlet end of said tube above the ground thereby selectively controlling upstream migration of marine life through said tube.

12. The assembly of claim 11, wherein said inlet frame comprises top, bottom and opposite side rails; and a side wall pivotally coupled to each of said side rails, said side wall being pivotal with respect to said inlet frame for diverting water into said tube.

13. The assembly of claim 12, wherein said at least one anchor comprises a stake attached to said top and bottom rails and extends past said bottom rail a sufficient distance for embedding in the ground.

14. The assembly of claim 12, wherein said side wall has a height substantially equal to said inlet frame.

15. The assembly of claim 11, wherein said outlet frame is coupled to said support structure for selectively adjusting a height of said outlet frame with respect to said base, and said outlet frame has a lower edge and a substantially horizontal ledge extending outwardly therefrom in a downstream direction.

16. A method of diverting the direction of water comprising the steps of providing a water conveyance assembly having a flexible and collapsible tube and a rigid inlet frame assembly, and at least one side wall pivotally coupled to a side rail of said inlet frame assembly;

securing the inlet frame to the ground in the path of said water and positioning said inlet frame for receiving the water;

coupling an inlet end of said tube to said inlet frame, wherein said inlet frame directs the flow of water into said tube;

pivotally adjusting the relative position of said at least one side wall with respect to said inlet frame and positioning said at least one side wall in said water and diverting the flow of water into said inlet frame and tube; and positioning an outlet end of said tube at a selected location and discharging said water from said tube.

17. The method of claim 16, wherein said outlet end of said tube is coupled to an outlet frame assembly, said outlet frame assembly including a base, a substantially upright support structure having a lower end coupled to said base and an outlet frame coupled to said outlet end of said tube, said method comprising the step of selectively positioning a height of said outlet frame on said support structure above a water level at said discharge end.

18. A method of diverting the downstream flow of water and controlling upstream migration of marine animals, comprising the steps of providing a water conveyance assembly having a water conveyance tube, an inlet frame assembly coupled to a water inlet end of said tube and an outlet frame assembly coupled to a discharge end of said tube;

securing said inlet frame assembly in a stream bed and diverting water into said inlet end of said tube;

positioning said discharge end of said tube downstream of said inlet end;

said outlet frame assembly comprising a ground engaging base, a substantially upright support structure and an outlet frame coupled to said support structure and spaced above said base, said outlet frame further being coupled to said discharge end of said tube for supporting said discharge end, said method further comprising positioning said discharge end of said tube above a water level at said discharge end of said tube a height to selectively control upstream migration of marine animals.

19. The method of claim 18, wherein said inlet frame assembly includes a wall member pivotally coupled to side rails of said inlet frame, said method comprising positioning said walls with respect to said inlet frame in the flow of water and diverting the flow of water into said tube.

* * * * *